US011177607B2

(12) United States Patent
Takayanagi et al.

(10) Patent No.: US 11,177,607 B2
(45) Date of Patent: Nov. 16, 2021

(54) CONNECTOR STRUCTURE AND HOUSING

(71) Applicant: Yazaki Corporation, Tokyo (JP)

(72) Inventors: Masayoshi Takayanagi, Makinohara (JP); Kazuhide Takahashi, Makinohara (JP); Keigo Tsubo, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/064,064

(22) Filed: Oct. 6, 2020

(65) Prior Publication Data

US 2021/0104835 A1 Apr. 8, 2021

(30) Foreign Application Priority Data

Oct. 7, 2019 (JP) ..... JP2019-184308

(51) Int. Cl.

| | |
|---|---|
| ***H01R 13/502*** | (2006.01) |
| ***H01R 13/506*** | (2006.01) |
| ***H01R 13/516*** | (2006.01) |
| ***H01R 13/6581*** | (2011.01) |

(52) U.S. Cl.

CPC ..... *H01R 13/5025* (2013.01); *H01R 13/506* (2013.01); *H01R 13/516* (2013.01); *H01R 13/6581* (2013.01)

(58) Field of Classification Search

CPC ..... H01R 13/6581; H01R 13/5025; H01R 13/506; H01R 13/516; H01R 13/6599; H01R 13/6594; H01R 13/6593; H01R 13/4362; H01R 12/716; H01R 13/659

See application file for complete search history.

(56) References Cited

U.S. PATENT DOCUMENTS

| | | | | |
|---|---|---|---|---|
| 6,193,555 | B1 | 2/2001 | Chang | |
| 6,776,652 | B2 * | 8/2004 | Nakura | G02B 6/3817 439/109 |
| 7,402,078 | B2 * | 7/2008 | Wan | H01R 13/6594 439/607.01 |
| 8,052,472 | B2 | 11/2011 | Uchida | |
| 10,797,420 | B2 * | 10/2020 | Maesoba | H01R 12/58 |
| 2012/0082421 | A1 | 4/2012 | Hsu et al. | |

FOREIGN PATENT DOCUMENTS

| | | | |
|---|---|---|---|
| CN | 107565296 | A | 1/2018 |
| JP | 2003-161864 | A | 6/2003 |

* cited by examiner

*Primary Examiner* — Briggitte R. Hammond

(74) *Attorney, Agent, or Firm* — Sughrue Mion, PLLC

(57) ABSTRACT

A connector structure includes a female housing and a male housing. The female housing includes a first holding portion holding first female terminals for power supply, a second holding portion adjacent to the first holding portion, formed as one unitary piece with the first holding portion, and holding second female terminals for communication, and a conductive shield layer separating the first holding portion from the second holding portion. The male housing includes a recessed portion configured to fit with the female housing, and holding first male terminals to be connected with the first female terminals and second male terminals to be connected with the second female terminals.

7 Claims, 16 Drawing Sheets

CONNECTOR STRUCTURE AND HOUSING

CROSS-REFERENCE TO RELATED APPLICATION(S)

The present application claims priority to and incorporates by reference the entire contents of Japanese Patent Application No. 2019-184308 filed in Japan on Oct. 7, 2019.

BACKGROUND OF THE INVENTION

1. Field of the Invention

The present invention relates to a connector structure and a housing.

2. Description of the Related Art

In conventional art, composite connector devices exist. Japanese Patent Application Laid-open No. 2003-161864 discloses a composite connector device formed of a composite connector in which an optical connection module and an electrical connection module are integrated at a clip housing, and an adaptor including an optical connection cavity and an electrical connection cavity.

In a connector structure including communication terminals and power supply terminals, it is desired to suppress reduction in communication quality. For example, it is preferable to protect a communication line from noise generated in a power supply line.

SUMMARY OF THE INVENTION

An object of the present invention is to provide a connector structure and a housing capable of suppressing reduction in communication quality.

In order to achieve the above mentioned object, a connector structure according to one aspect of the present invention includes a female housing including a first holding portion configured to hold first female terminals for power supply, a second holding portion adjacent to the first holding portion, formed as one unitary piece with the first holding portion, and configured to hold second female terminals for communication, and a conductive shield layer configured to separate the first holding portion from the second holding portion; and a male housing including a recessed portion configured to fit with the female housing, and configured to hold first male terminals to be connected with the first female terminals and second male terminals to be connected with the second female terminals.

According to another aspect of the present invention, in the connector structure, it is preferable that the female housing includes a main member into which the first female terminals and the second female terminals are inserted, and a holding member configured to be engaged with the main member to hold the first female terminals, the holding member includes a partition wall configured to separate the first holding portion from the second holding portion, and the shield layer is provided on the partition wall.

According to still another aspect of the present invention, in the connector structure, it is preferable that the shield layer is a plated layer formed on the partition wall.

According to still another aspect of the present invention, in the connector structure, it is preferable that the connector structure further includes a conductive shield case configured to be attached to the male housing to cover the second holding portion and grounded to a substrate; and a conductive tubular shield member disposed in the recessed portion, grounded via the shield case, and covering a connection portion between the second male terminals and the second female terminals, wherein an outer side surface of the male housing includes a groove formed along a border between the first holding portion and the second holding portion, and the shield case includes an insertion wall portion configured to be inserted into the groove.

According to still another aspect of the present invention, in the connector structure, it is preferable that the female housing includes a main member into which the first female terminals and the second female terminals are inserted, and a holding member configured to be engaged with the main member to hold the first female terminals, the holding member includes a partition wall configured to separate the first holding portion from the second holding portion, the shield layer is provided on the partition wall, and the insertion wall portion is opposed to the partition wall in a depth direction of the groove.

In order to achieve the above mentioned object, a housing according to still another aspect of the present invention includes a first holding portion configured to hold first female terminals for power supply; a second holding portion adjacent to the first holding portion, formed as one unitary piece with the first holding portion, and configured to hold second female terminals for communication; and a conductive shield layer configured to separate the first holding portion from the second holding portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A connector structure and a housing according to an embodiment of the present invention will now be described in detail hereinafter with reference to drawings. The present invention is not limited to the embodiment. In addition, constituent elements in the following embodiment include elements that the skilled person can easily conceive or substantially the same ones.

EMBODIMENT

Figure 1:
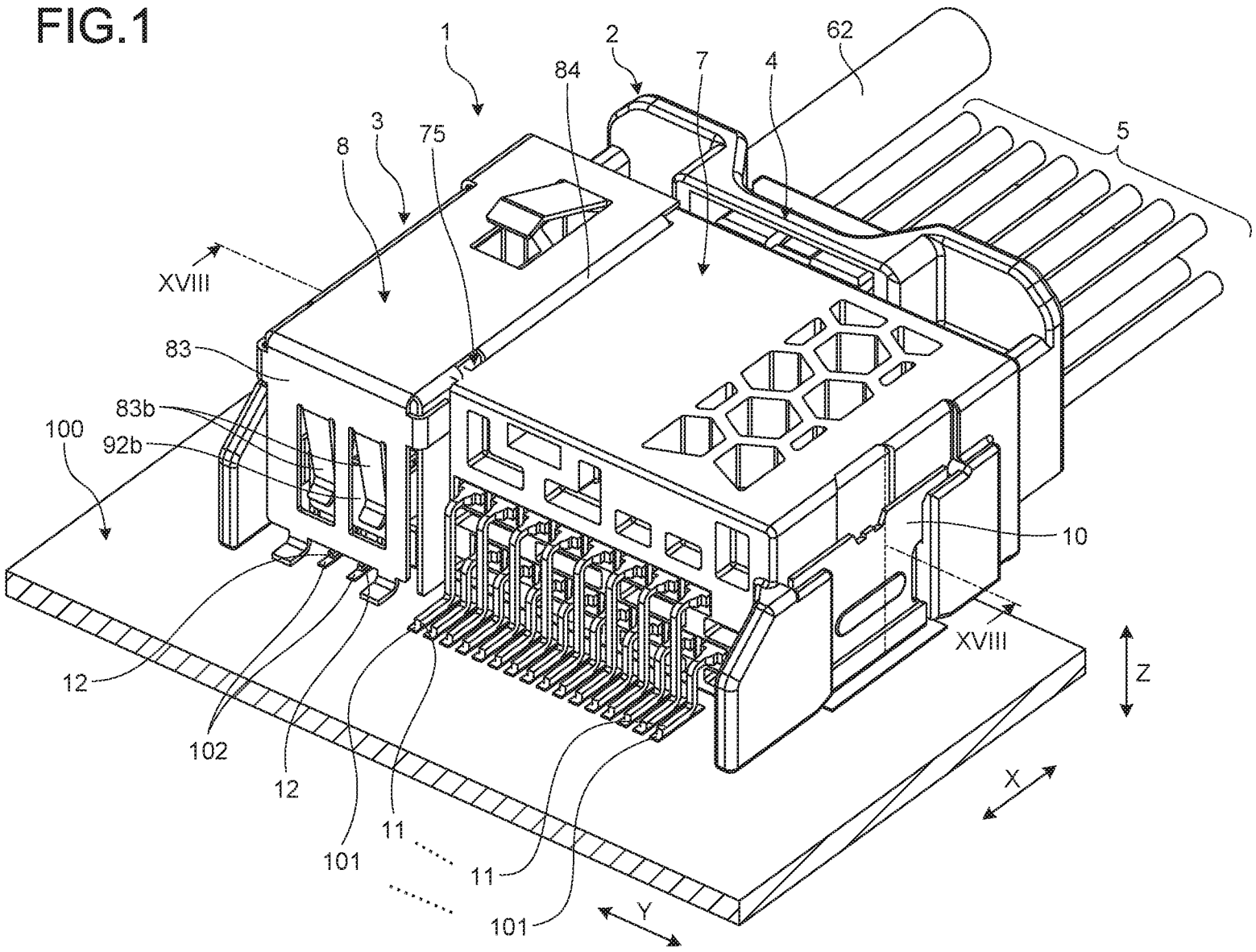
FIG. 1 is a perspective view of a connector structure according to an embodiment.
Figure 3:
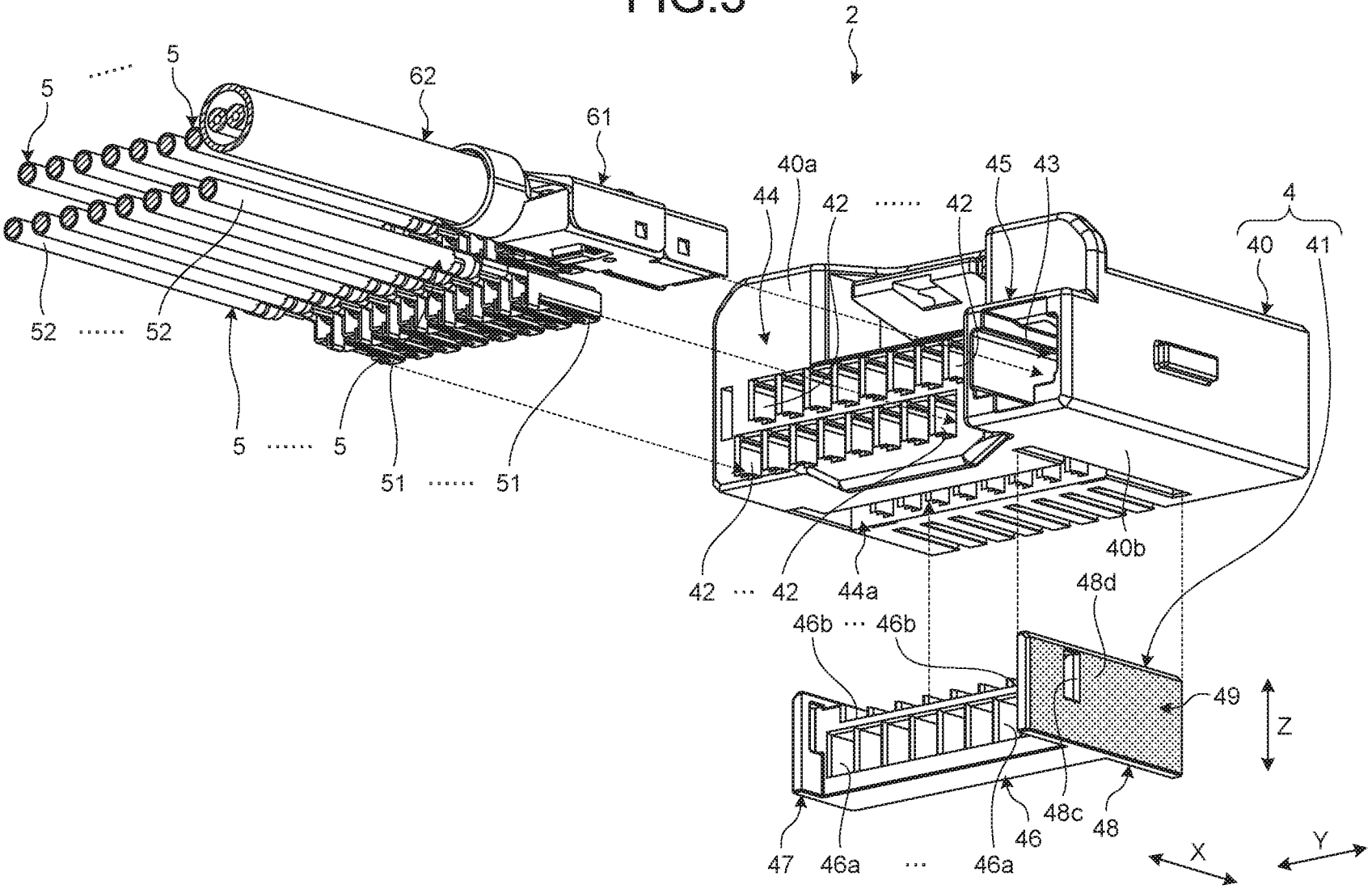
FIG. 3 is an exploded perspective view of a female unit according to the embodiment.
Figure 4:
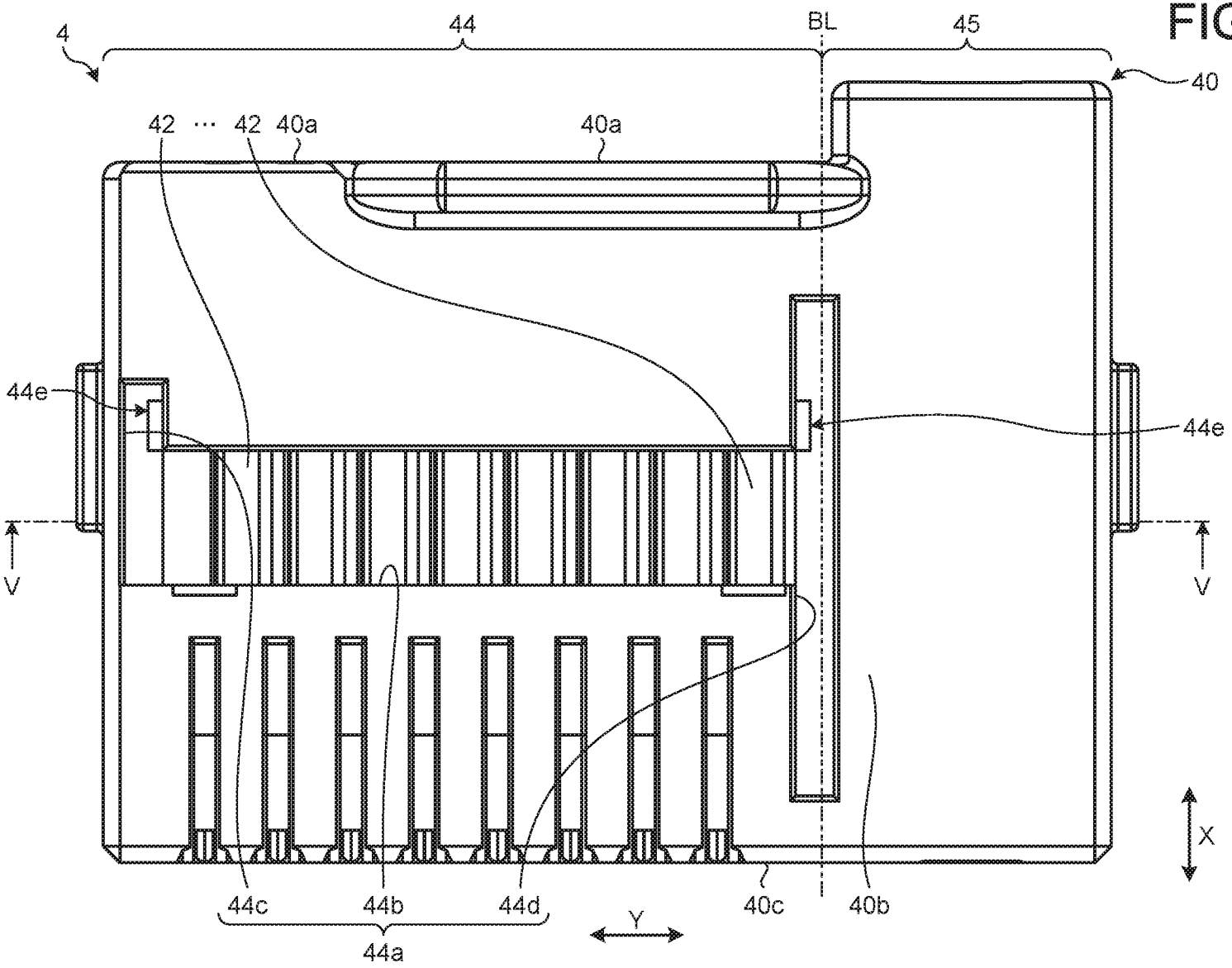
FIG. 4 is a bottom view of a main member of a female housing according to the embodiment.
Figure 5:
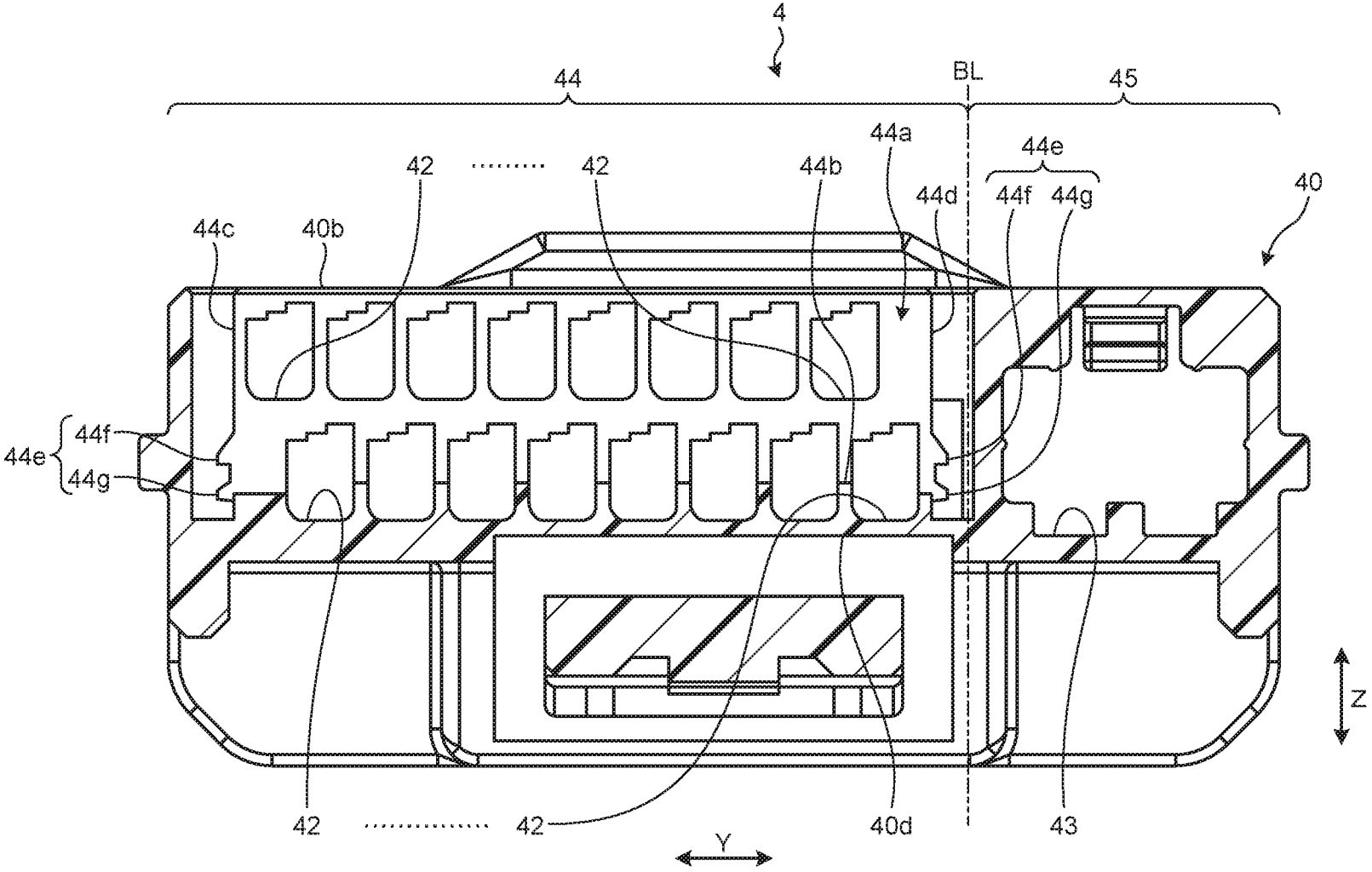
FIG. 5 is a cross-sectional view of the main member of the female housing according to the embodiment.
Figure 6:
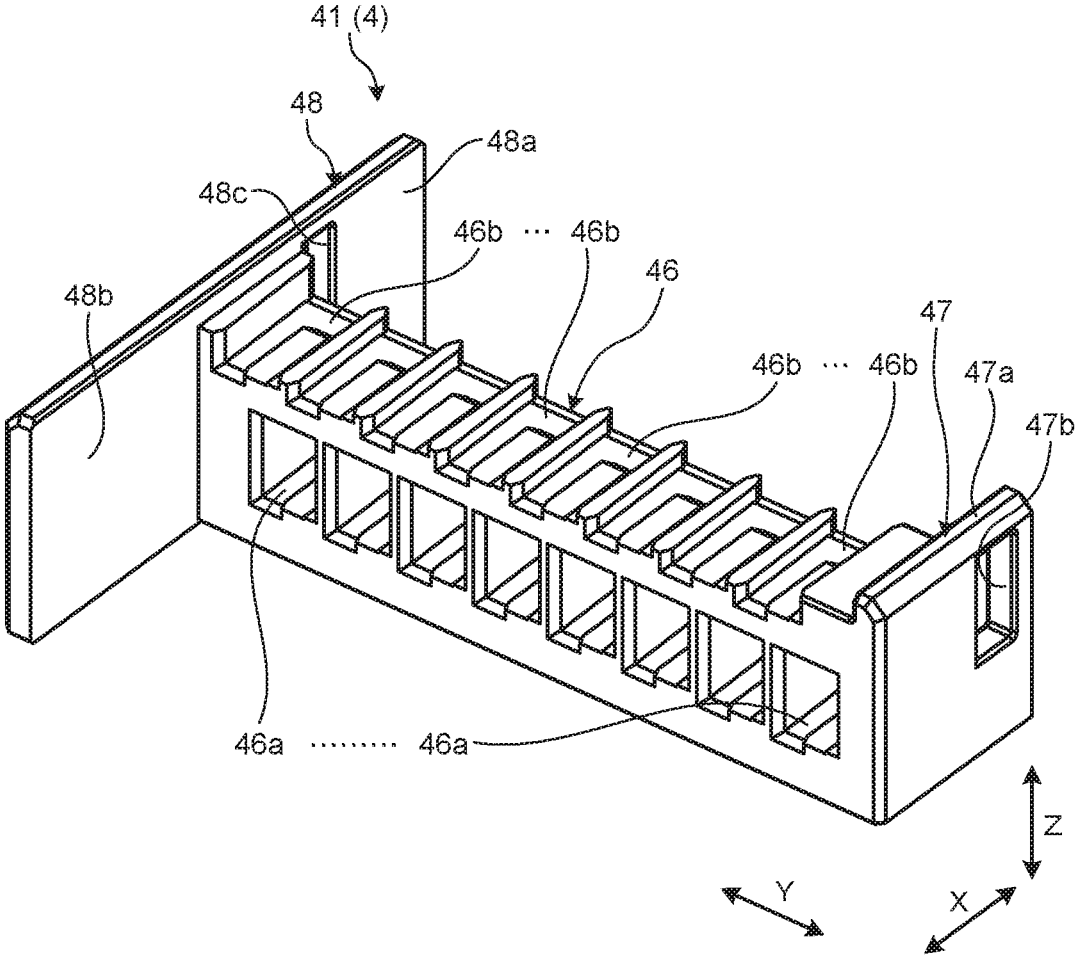
FIG. 6 is a perspective view of a holding member according to the embodiment.
Figure 7:
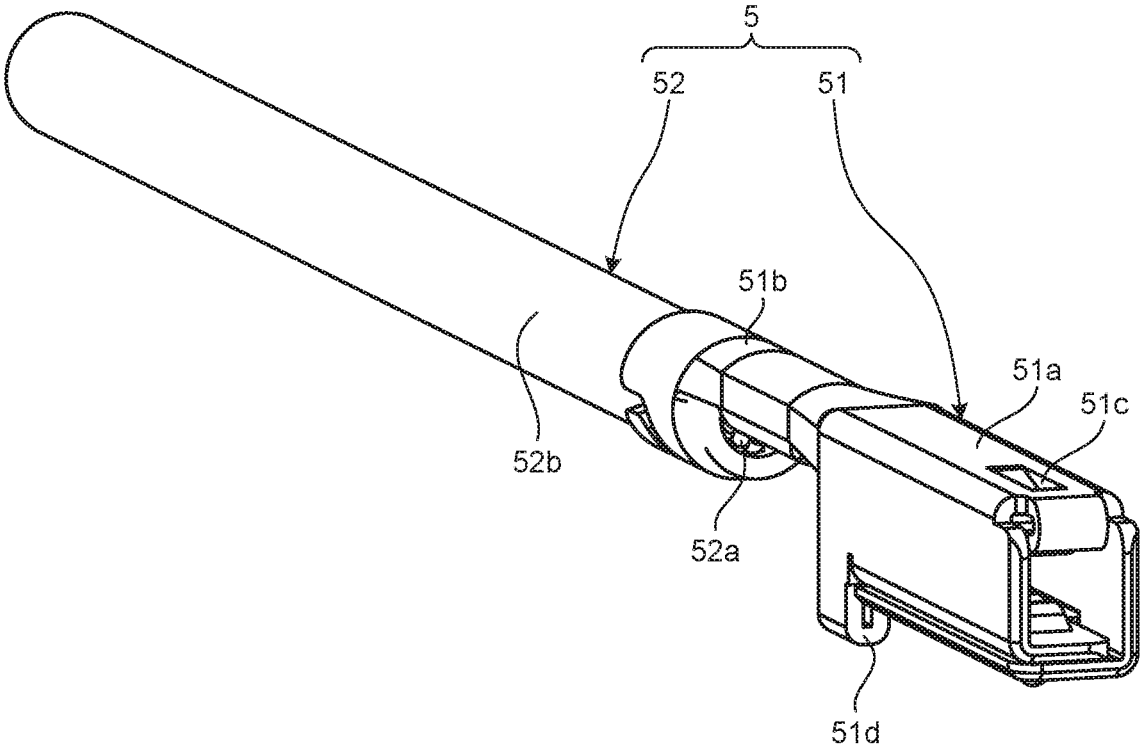
FIG. 7 is a perspective view of a first female terminal and an electrical wire according to the embodiment.
Figure 8:
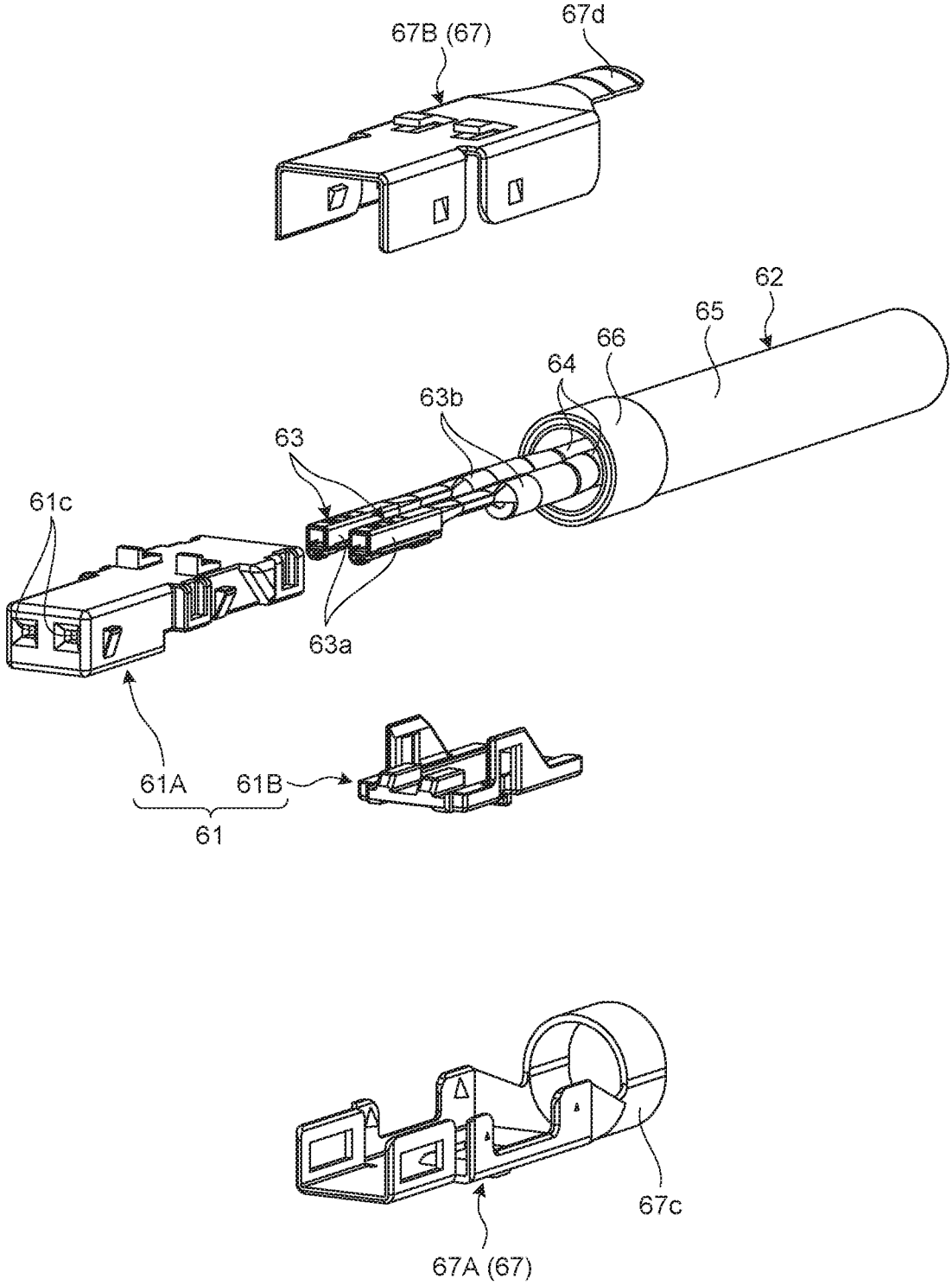
FIG. 8 is an exploded perspective view of a second female terminal, a communication connector, and a communication cable according to the embodiment.
Figure 9:
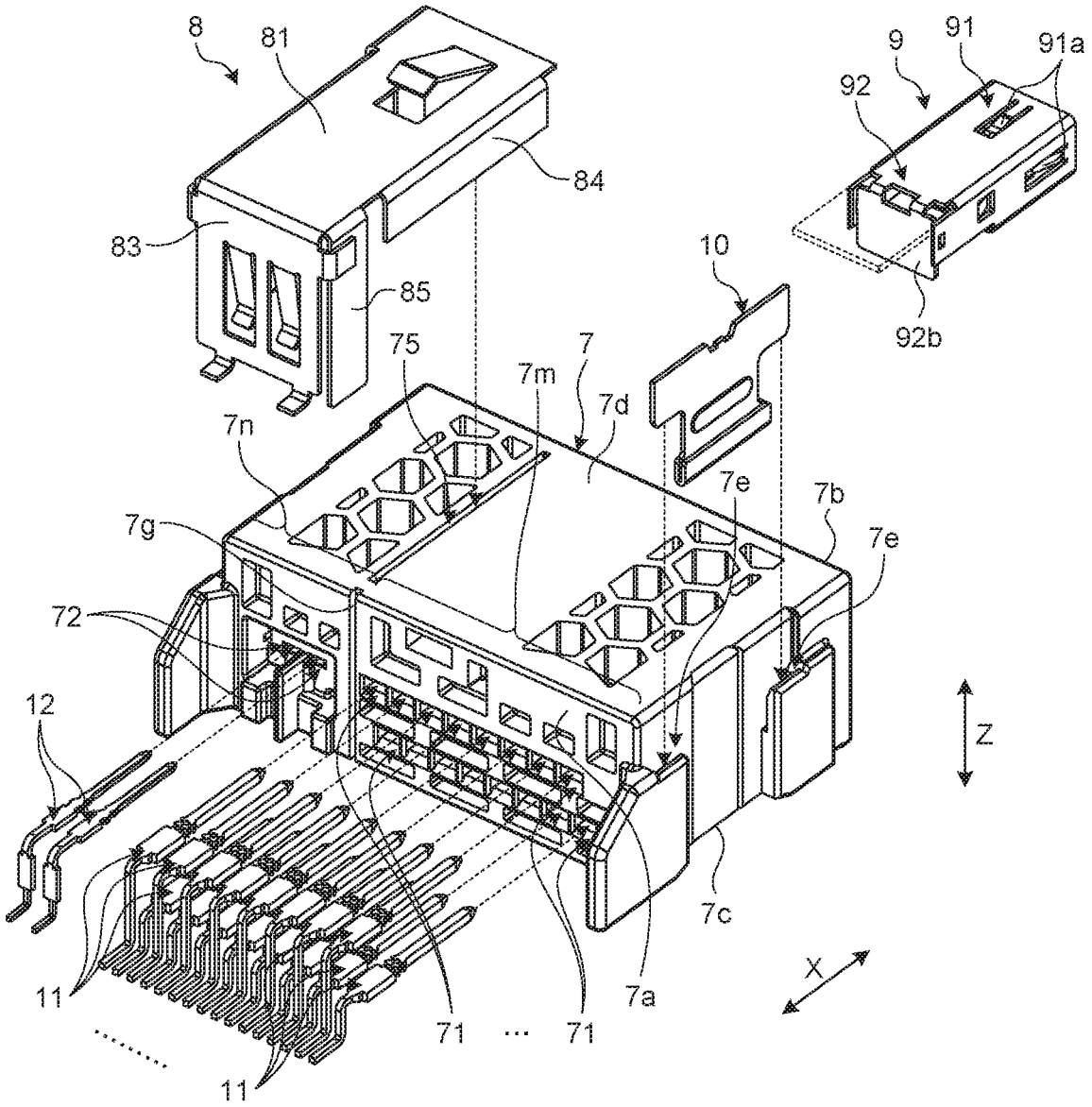
FIG. 9 is an exploded perspective view of a male unit according to the embodiment.
Figure 10:
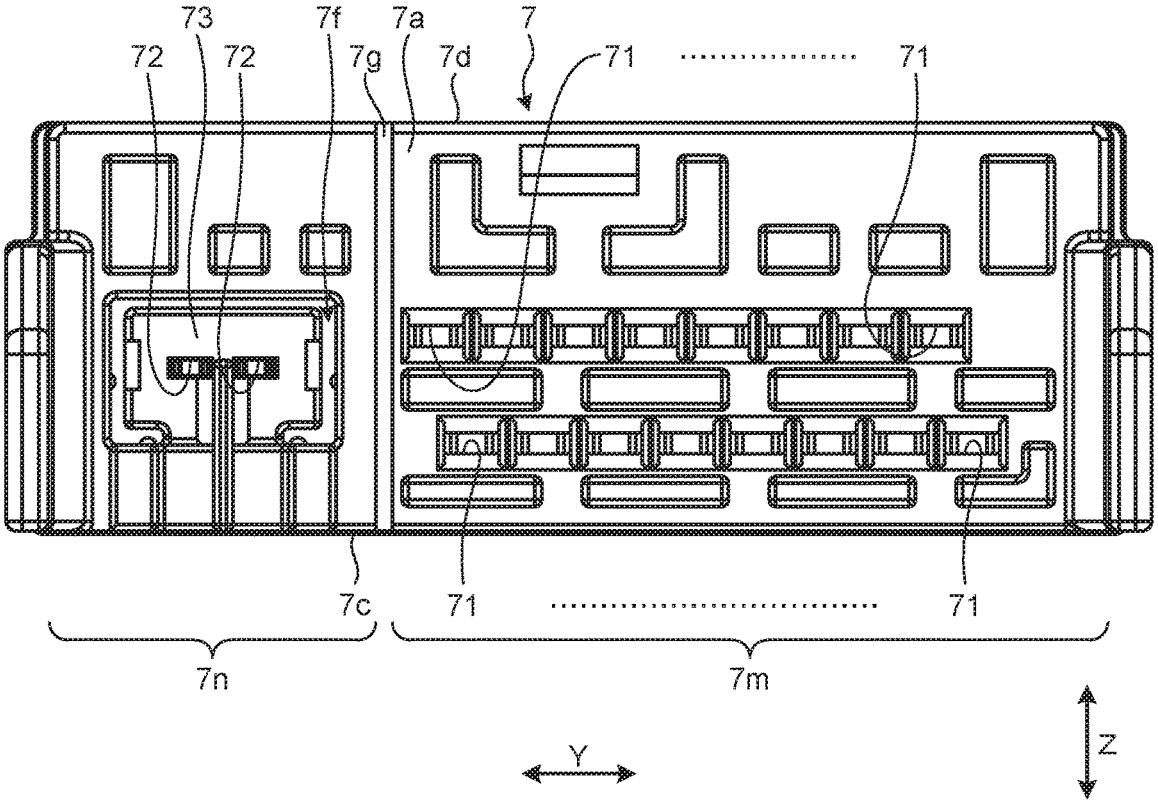
FIG. 10 is a back view of a male housing according to the embodiment.

An embodiment will now be described with reference to FIG. 1 to FIG. 18. The present embodiment relates to a connector structure and a housing. FIG. 1 is a perspective view of a connector structure according to the embodiment, FIG. 2 is an exploded perspective view of the connector structure according to the embodiment, FIG. 3 is an exploded perspective view of a female unit according to the embodiment, FIG. 4 is a bottom view of a main member of a female housing according to the embodiment, FIG. 5 is a cross-sectional view of the main member of the female housing according to the embodiment, FIG. 6 is a perspective view of a holding member according to the embodiment, FIG. 7 is a perspective view of a first female terminal and an electrical wire according to the embodiment, FIG. 8 is an exploded perspective view of a second female terminal, a communication connector, and a communication cable according to the embodiment, FIG. 9 is an exploded perspective view of a male unit according to the embodiment, and FIG. 10 is a back view of a male housing according to the embodiment.

Figure 11:
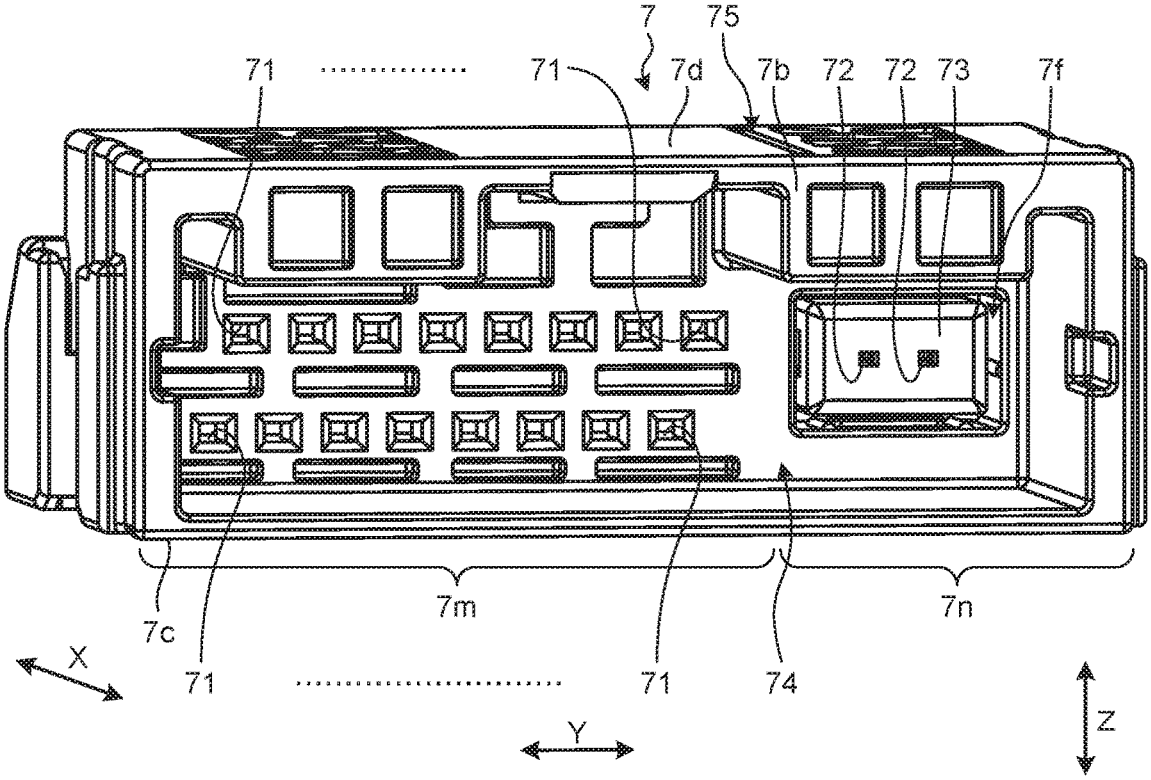
FIG. 11 is a perspective view of the male housing as viewed from a front side according to the embodiment.
Figure 12:
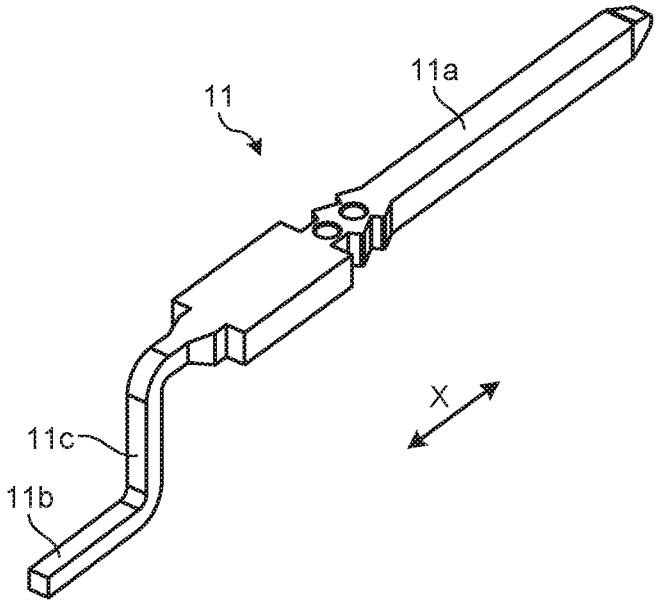
FIG. 12 is a perspective view of a first male terminal according to the embodiment.
Figure 13:
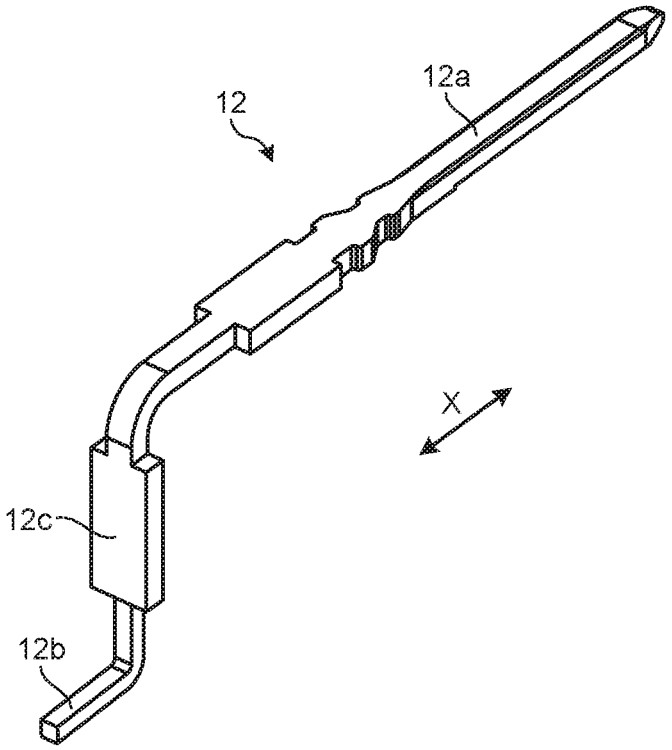
FIG. 13 is a perspective view of a second male terminal according to the embodiment.
Figure 14:
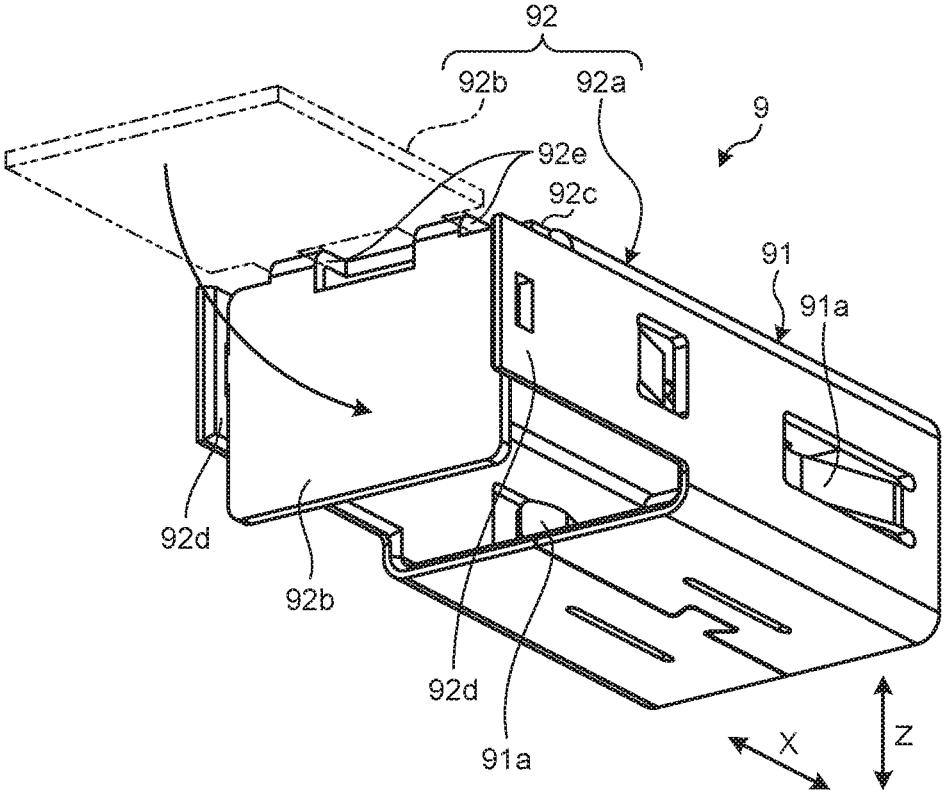
FIG. 14 is a perspective view of a shield member according to the embodiment.
Figure 15:
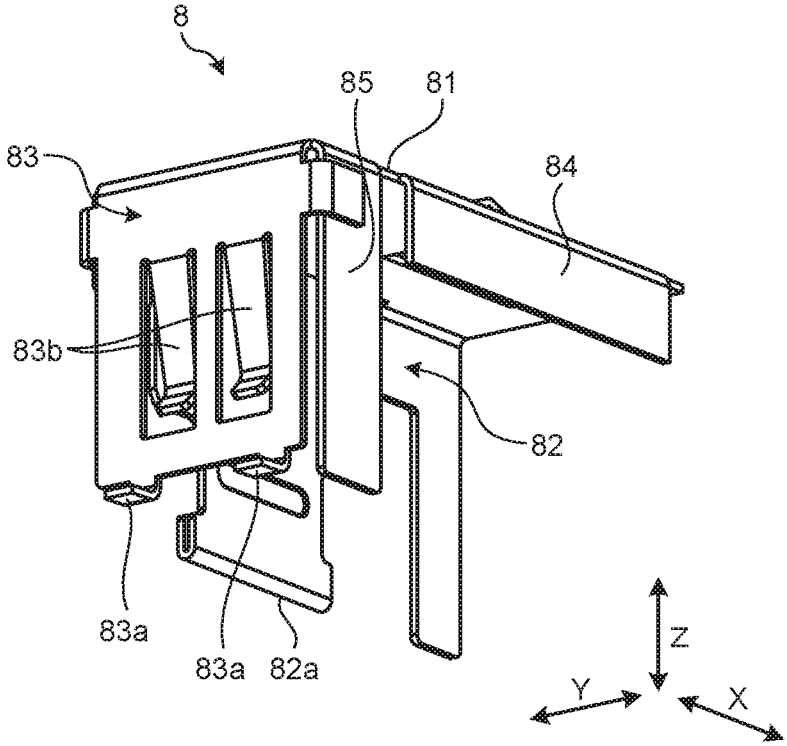
FIG. 15 is a perspective view of a shield case according to the embodiment.
Figure 16:
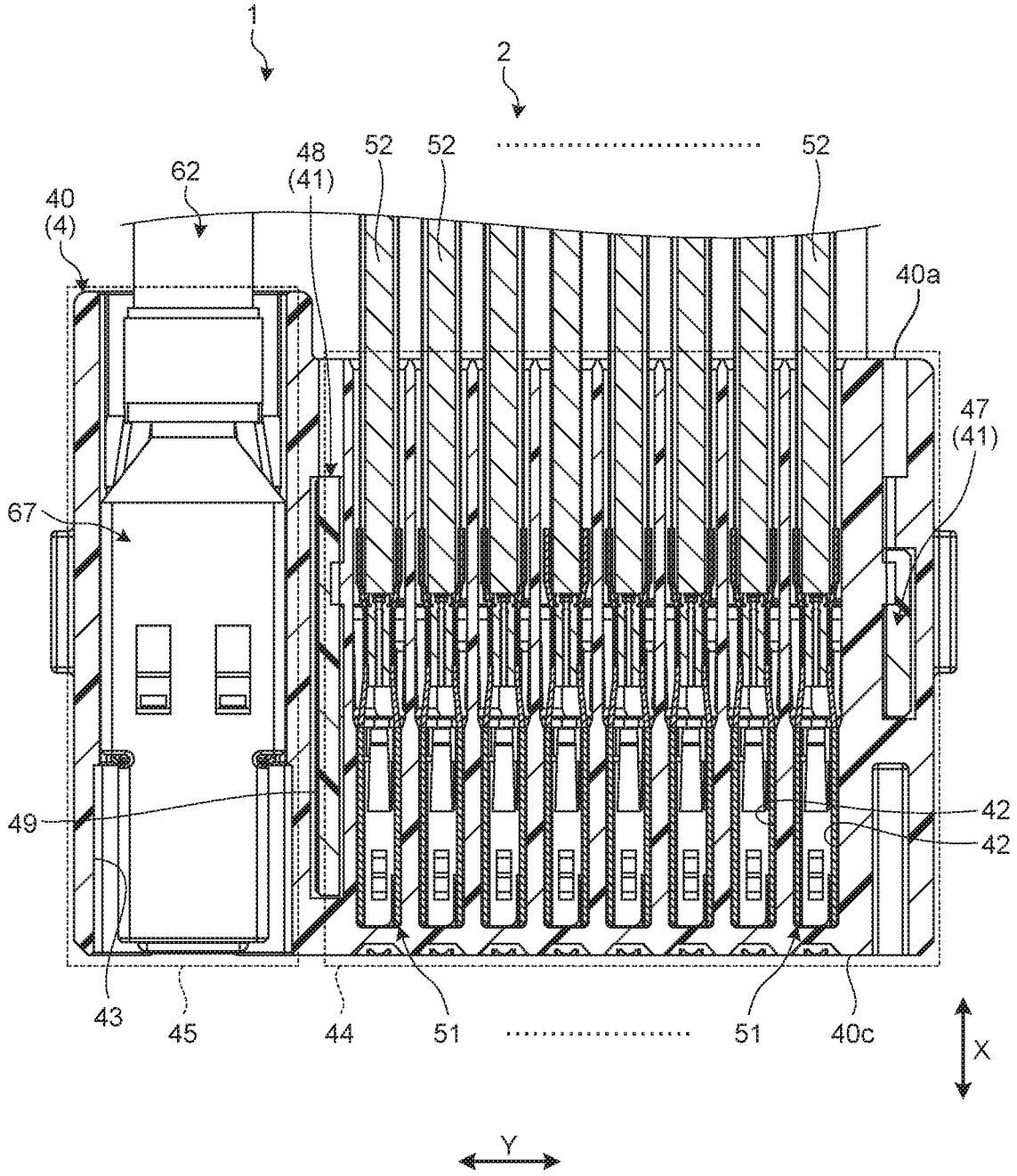
FIG. 16 is a cross-sectional view of the female unit according to the embodiment.
Figure 17:
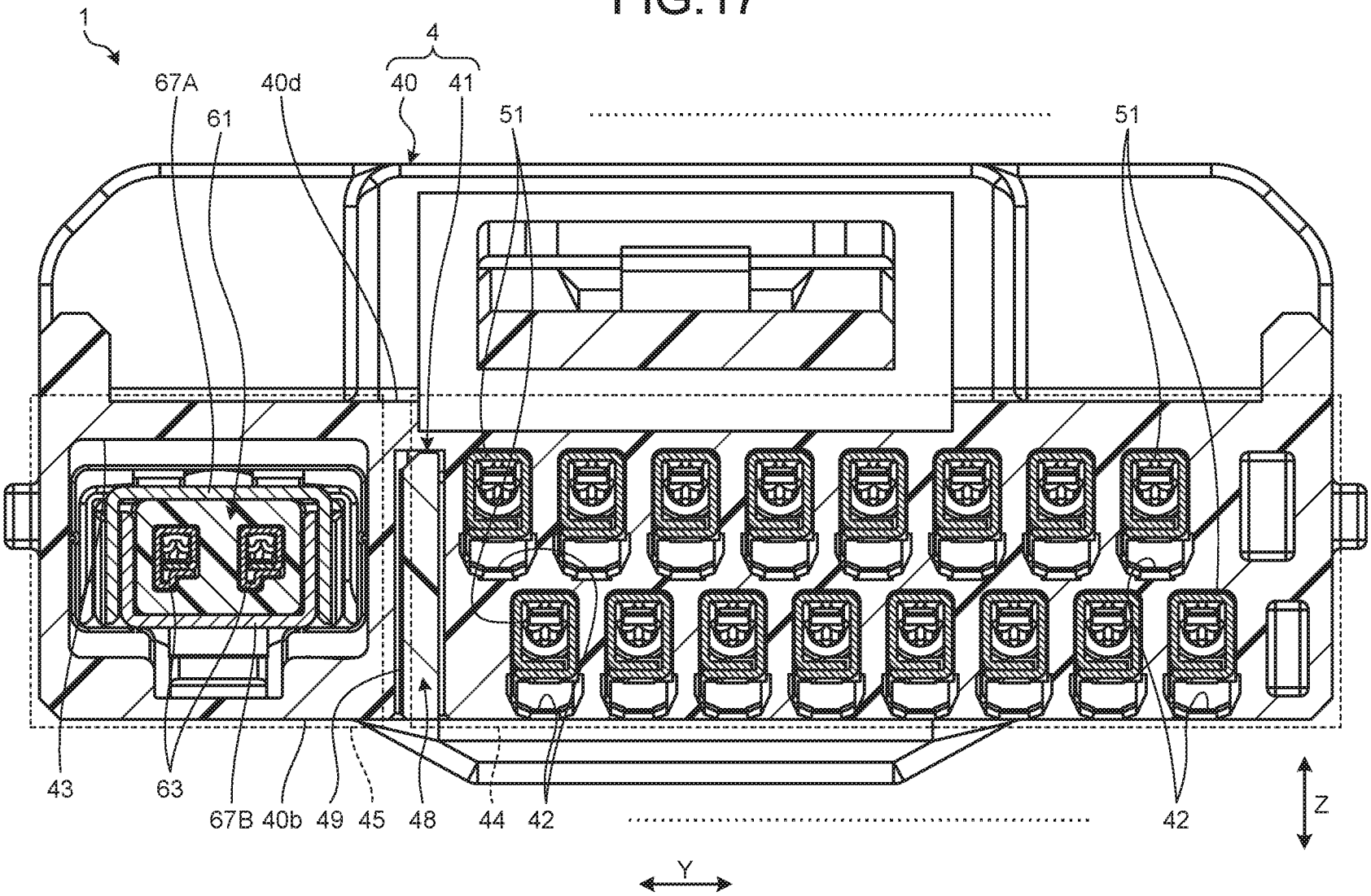
FIG. 17 is another cross-sectional view of the female unit according to the embodiment.
Figure 18:
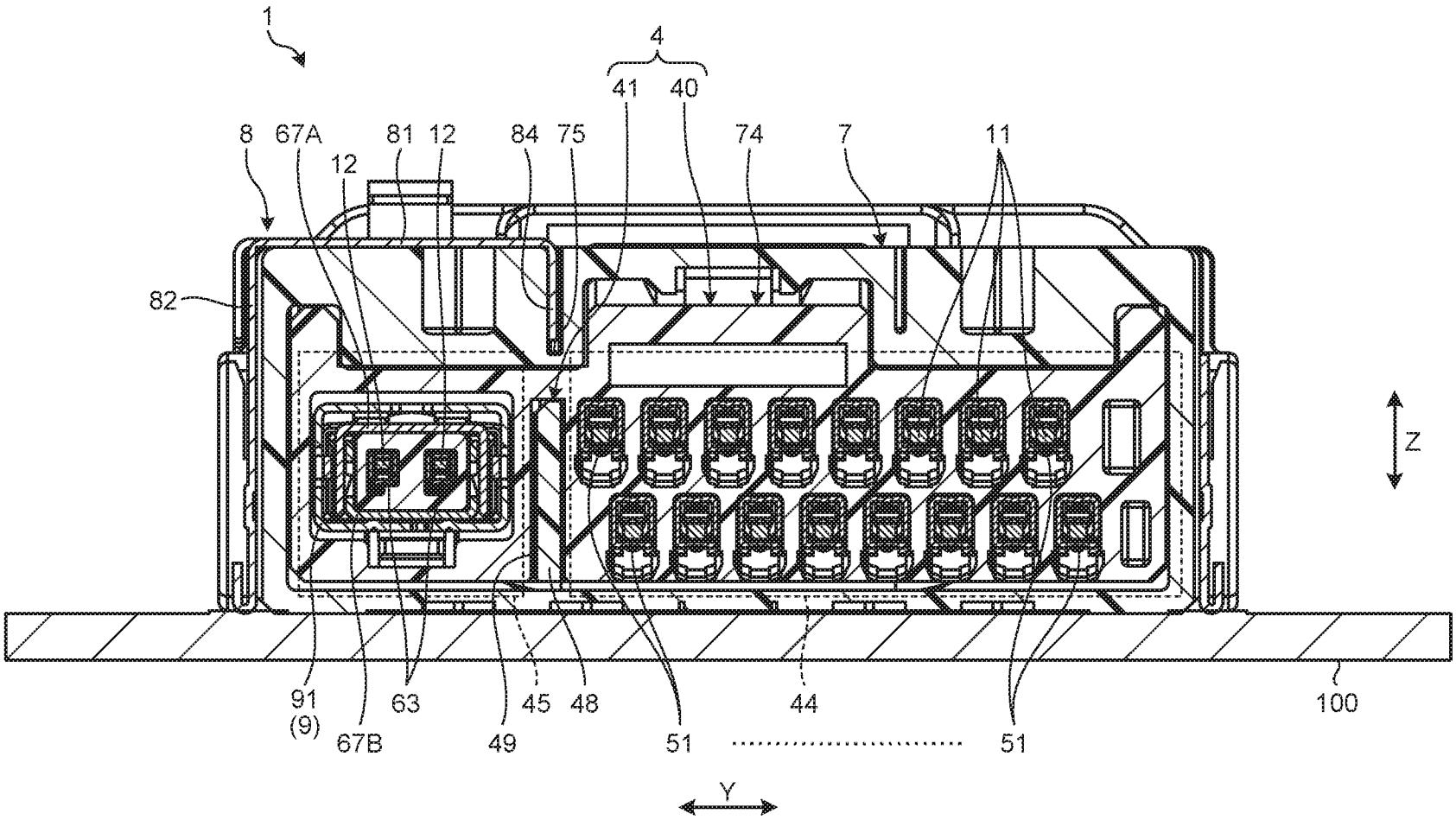
FIG. 18 is a cross-sectional view of the connector structure according to the embodiment.

FIG. 11 is a perspective view of the male housing as viewed from a front side according to the embodiment, FIG. 12 is a perspective view of a first male terminal according to the embodiment, FIG. 13 is a perspective view of a second male terminal according to the embodiment, FIG. 14 is a perspective view of a shield member according to the embodiment, FIG. 15 is a perspective view of a shield case according to the embodiment, FIG. 16 is a cross-sectional view of the female unit according to the embodiment, FIG. 17 is another cross-sectional view of the female unit according to the embodiment, and FIG. 18 is a cross-sectional view of the connector structure according to the embodiment. FIG. 5 illustrates a cross section taken along line V-V of FIG. 4. FIG. 16 illustrates a cross section taken along line XVI-XVI of FIG. 2. FIG. 17 illustrates a cross section taken along line XVII-XVII of FIG. 2. FIG. 18 illustrates a cross section taken along line XVIII-XVIII of FIG. 1.

Figure 2:
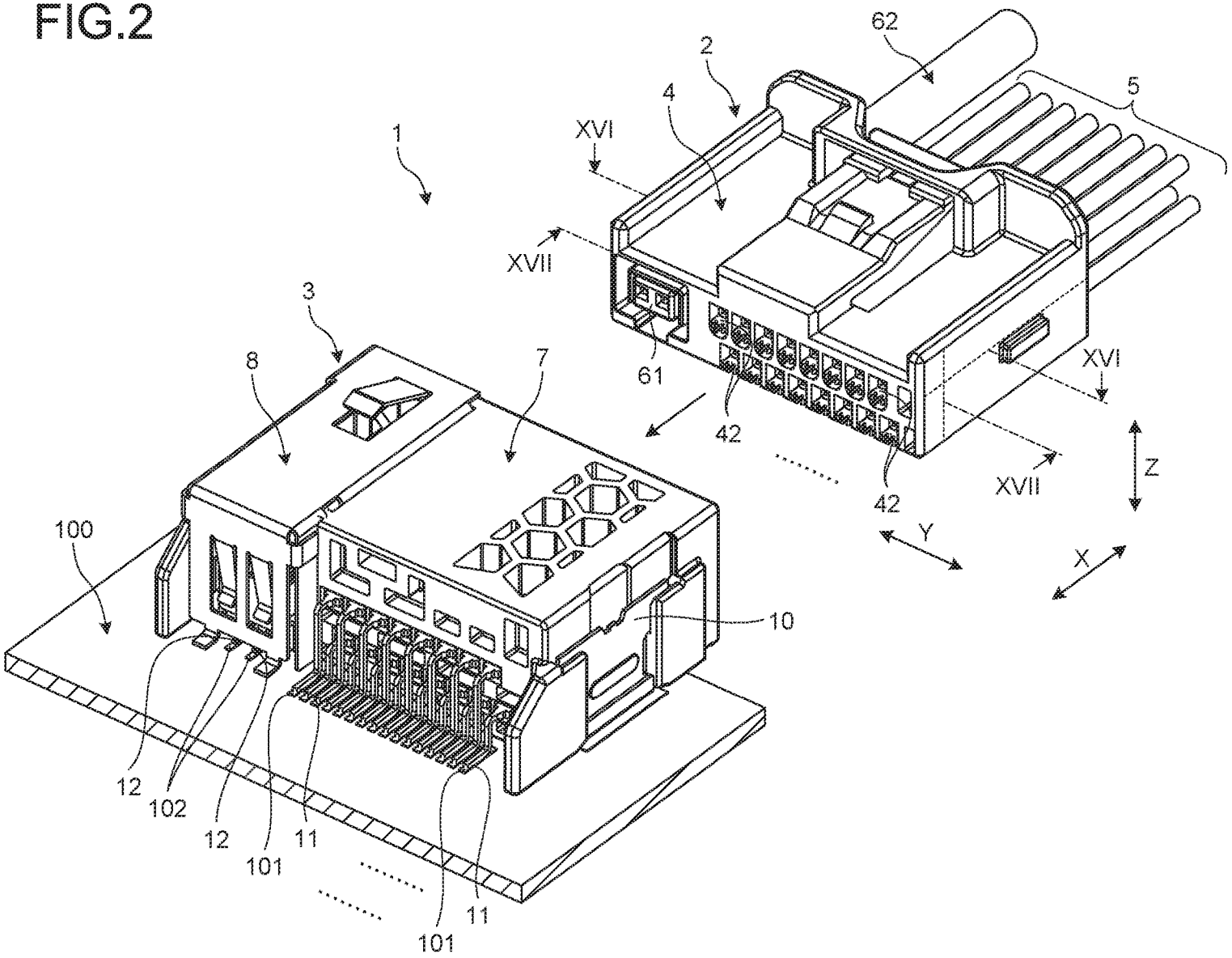
FIG. 2 is an exploded perspective view of the connector structure according to the embodiment.

As illustrated in FIG. 1 and FIG. 2, a connector structure 1 according to the embodiment includes a female unit 2 and a male unit 3. The female unit 2 is a composite connector including first female terminals 51 for power supply and second female terminals 63 for communication. The male unit 3 is a composite connector including first male terminals 11 for power supply and second male terminals 12 for communication. The male unit 3 according to the present embodiment is a substrate connector fixed on a substrate 100.

The substrate 100 includes first electrode parts 101 and second electrode parts 102. The first electrode parts 101 serve as power supply electrode parts. The first male terminals 11 are electrically and physically connected with the first electrode parts 101. The first electrode parts 101 are connected with an electronic component or the like via a circuit formed on the substrate 100. The second electrode parts 102 serve as communication electrode parts. The second male terminals 12 are electrically and physically connected with the second electrode parts 102. The second electrode parts 102 are connected with a communication circuit mounted on the substrate 100. The substrate 100 further includes a pad on which a peg 10 is fixed and ground conductors with which a shield case 8 is electrically connected.

The female unit 2 includes a female housing 4 and terminal-equipped electrical wires 5, as illustrated in FIG. 3. The female unit 2 may further include a communication connector 61 and a communication cable 62. The female housing 4 includes a main member 40 and a holding member 41. The main member 40 and the holding member 41 are molded of, for example, insulating synthetic resin.

The main member 40 has a substantially rectangular parallelepiped shape. A plurality of first holes 42 and a second hole 43 are formed in the main member 40. The first holes 42 are hole portions into which first female terminals 51 of the terminal-equipped electrical wires 5 are inserted. The second hole 43 is a hole portion into which the communication connector 61 is inserted. Insertion ports of the first holes 42 and the second hole 43 are provided in a back surface 40*a* of the main member 40. Specifically, the first female terminals 51 and the communication connector 61 are inserted into the main member 40 from the back surface 40*a* side.

In the following explanation, the insertion direction in which the first female terminals 51 and the communication connector 61 are inserted into the main member 40 is referred to as "first direction X". The main member 40 according to the present embodiment has a cross section orthogonal to the first direction X, and the cross section has a substantially rectangular shape. In the following explanation, the longitudinal direction in the cross-sectional shape of the main member 40 is referred to as "second direction Y", and the short direction in the cross-sectional shape is referred to as "third direction Z". Each of the first direction X, the second direction Y, and the third direction Z is orthogonal to the other two directions.

As illustrated in FIG. 4 and FIG. 5, the main member 40 includes a first holding portion 44 including the first holes 42 and a second holding portion 45 including the second hole 43. The first holding portion 44 is a portion on one side in the second direction Y in the main member 40. The second holding portion 45 is a portion on the other side in the second direction Y in the main member 40. Specifically, the first holding portion 44 and the second holding portion 45 are adjacent to each other in the second direction Y.

The first holding portion 44 is a portion holding the first female terminals 51 for power supply. In the first holding portion 44, the first holes 42 are arranged along the second direction Y and the third direction Z. In the first holding portion 44 according to the present embodiment, the first holes 42 arranged along the second direction Y are arranged in two lines superimposed in the third direction Z. The first holes 42 are formed to extend from a front surface 40*c* to the back surface 40*a* of the main member 40.

The first holding portion 44 includes a recessed portion 44*a* into which the holding member 41 is inserted. An insertion port of the recessed portion 44*a* is provided in a first side surface 40*b* of the main member 40. The first side surface 40*b* is a side surface opposed to the substrate 100 when the female unit 2 is fitted with the male unit 3. The recessed portion 44*a* communicates with each of the first holes 42.

As illustrated in FIG. 4, the recessed portion 44*a* includes a main portion 44*b*, a widening portion 44*c*, and a partitioning portion 44*d*. The main portion 44*b* extends in the second direction Y, and crosses the first holes 42. The main portion 44*b* is provided to extend from one end portion to the other end portion of the first holding portion 44 along the second direction Y. The main portion 44*b* is disposed in a middle portion in the first direction X in the first holding portion 44.

The widening portion 44*c* is located at one end in the second direction Y in the recessed portion 44*a*. The widening portion 44*c* is widened along the first direction X with respect to the main portion 44*b*. The widening portion 44*c* spreads, for example, toward the back surface 40*a*.

The partitioning portion 44*d* is located at the other end in the second direction Y in the recessed portion 44*a*. The partitioning portion 44*d* is positioned on a border BL between the first holding portion 44 and the second holding portion 45. The border BL is a border surface between the first holding portion 44 and the second holding portion 45, and orthogonal to the second direction Y. The partitioning portion 44*d* spreads toward each of the back surface 40*a* and the front surface 40*c* with respect to the main portion 44*b*. Specifically, the partitioning portion 44*d* extends along the first direction X to separate the first holding portion 44 from the second holding portion 45.

The widening portion 44*c* and the partitioning portion 44*d* are provided with respective engaging portions 44*e* engaged with the holding member 41. The two engaging portions 44*e* are arranged in the same position in the first direction X, and oriented in mutually opposite directions.

As illustrated in FIG. 5, the main portion 44*b* communicates with each of the first holes 42 arranged in two lines. The depth of the recessed portion 44*a* extends from the first side surface 40*b* to the vicinity of a second side surface 40*d*. The second side surface 40*d* is one of side surfaces included in the main member 40, and oriented to the side opposite to the first side surface 40*b*. Each of the engaging portions 44*e* includes a first projection 44*f* and a second projection 44*g*. The first projection 44*f* and the second projection 44*g* are arranged side by side in the third direction Z. The first projections 44*f* serve as locking portions locking the holding member 41 at a temporary locking position. The second projections 44*g* serve as locking portions locking the holding member 41 at a regular locking position.

As illustrated in FIG. 3 and FIG. 6, the holding member 41 includes a main member 46, a side wall 47, and a partition wall 48. The main member 46, the side wall 47, and the partition wall 48 are formed as one unitary piece. The main member 46 is a portion formed in a prism shape, and fitted into the main portion 44*b* of the recessed portion 44*a*. The main member 46 includes a plurality of insertion holes 46*a* and a plurality of grooves 46*b*. The insertion holes 46*a* and the grooves 46*b* are arranged to correspond to the first holes 42 of the main member 40.

The side wall 47 is connected with one end of the main member 46 in the longitudinal direction. The side wall 47 is fitted into the widening portion 44*c* of the recessed portion 44*a*. The side wall 47 includes a projecting portion 47*a* projecting from the main member 46 in the first direction X. The projecting portion 47*a* includes an engagement hole 47*b*. The engagement hole 47*b* is engaged with the engaging portion 44*e* provided in the widening portion 44*c*, and locked with the engaging portion 44*e*. The engagement hole 47*b* extends through the projecting portion 47*a*.

The partition wall 48 is connected with the other end of the main member 46 in the longitudinal direction of the main member 46. The partition wall 48 is fitted into the partitioning portion 44*d* of the recessed portion 44*a*. The partition wall 48 includes a first projecting portion 48*a* and a second projecting portion 48*b*. The first projecting portion 48*a* projects from the main member 46 toward one side of the first direction X. The second projecting portion 48*b* projects from the main member 46 toward the other side of the first direction X. The first projecting portion 48*a* is opposed to the projecting portion 47*a* of the side wall 47 in the second direction Y. The first projecting portion 48*a* includes an engagement hole 48*c*. The engagement hole 48*c* is engaged with the engaging portion 44*e* provided in the partitioning portion 44*d*, and locked with the engaging portion 44*e*. The engagement hole 48*c* extends through the first projecting portion 48*a*.

When the engagement holes 47*b* and 48*c* are engaged with the first projections 44*f* of the engaging portions 44*e*, the holding member 41 is locked at the temporary locking position. When the holding member 41 is locked at the temporary locking position, terminal connection portions 51*a* of the first female terminals 51 are enabled to pass through the insertion holes 46*a* and the grooves 46*b* of the holding member 41. Specifically, the holding member 41 allows insertion of the first female terminals 51 to the deep portions of the first holes 42. When all the first female terminals 51 are inserted into the first holes 42, the holding member 41 is moved to the regular locking position. In the regular locking position, the engagement holes 47*b* and 48*c* are engaged with the second projections 44*g* of the engaging portions 44*e*. The holding member 41 in the regular locking position locks projecting portions 51*d* of the terminal connection portions 51*a*, and regulates falling of the first female terminals 51 out of the first holes 42.

As illustrated in FIG. 3, a conductive shield layer 49 is disposed on an outer side surface 48*d* of the partition wall 48. The shield layer 49 is a plated layer formed on the outer side surface 48*d*. The shield layer 49 is metal plating, and includes metal of at least one of tin, nickel, and gold, for example. The shield layer 49 is provided on, for example, the whole surface of the outer side surface 48*d*. The shield layer 49 separates the first holding portion 44 from the second holding portion 45, in a state in which the holding member 41 is fitted into the main member 40. The shield layer 49 enables protection of the communication connector 61 and/or the communication cable 62 in the second holding portion 45 from noise generated in the first holding portion 44.

As illustrated in FIG. 7, each of the terminal-equipped electrical wires 5 includes the first female terminal 51 and an electrical wire 52. The electrical wire 52 is a covered wire including a core wire 52*a* and an insulating cover 52*b* covering the core wire 52*a*. Each of the first female terminals 51 is a crimped terminal crimped to the electrical wire 52. Each of the first female terminals 51 is formed of a metal plate having conductivity. Each of the first female terminals 51 includes a terminal connection portion 51*a* and an electrical wire connection portion 51*b*. The terminal connection portion 51*a* is a portion connected with the first male terminal 11. The terminal connection portion 51*a* has a square tube shape. The terminal connection portion 51*a* includes an engagement hole 51*c* and a projecting portion 51*d*. The engagement hole 51*c* is a hole portion engaged with the main member 40 of the female housing 4. The projecting portion 51*d* is a portion locked with the holding member 41 of the female housing 4. The electrical wire connection portion 51*b* is a portion crimped to the core wire 52*a* and the cover 52*b* of the electrical wire 52.

As illustrated in FIG. 8, the second female terminals 63 are crimp terminals crimped to communication lines 64 of the communication cable 62. Each of the second female terminals 63 is formed of a metal plate having conductivity. The communication cable 62 includes two communication lines 64, a cover 65, and a braid 66. The two communication lines 64 are covered with the cover 65 and the braid 66. Each of the second female terminals 63 includes a terminal connection portion 63*a* and an electrical wire connection portion 63*b*. The terminal connection portion 63*a* is a portion connected with the second male terminal 12. The terminal connection portion 63*a* has a square tube shape. The electrical wire connection portion 63*b* is a portion crimped to the core wire and the cover of the communication line 64.

The communication connector 61 includes a main member 61A and a cover 61B. The main member 61A has a square tube shape, and includes two insertion holes 61*c* into which the second male terminals 12 are inserted. The two second female terminals 63 are inserted into the main member 61A. The cover 61B is engaged with the main member 61A, and holds the second female terminals 63. A shield member 67 is attached to the communication connector 61 and the communication cable 62. The shield member 67 includes a main member 67A and a cover 67B. By engagement of the main member 67A with the cover 67B, a tubular shield structure covering the communication connector 61 is formed. The main member 67A includes a caulking portion 67*c*. The caulking portion 67*c* is caulked on the braid 66 and an end portion 67*d* of the cover 67B, and electrically connected with the braid 66.

As illustrated in FIG. 9, the male unit 3 includes a male housing 7, a shield case 8, a shield member 9, a peg 10, first male terminals 11, and second male terminals 12. The male unit 3 is a composite connector including the first male terminals 11 for power supply and the second male terminals 12 for communication.

The male housing 7 is molded of, for example, insulating synthetic resin. The male housing 7 has, for example, a rectangular parallelepiped shape. A plurality of first holding holes 71 and two second holding holes 72 are formed in the male housing 7. The first holding holes 71 are holes to hold the first male terminals 11 for power supply. The second holding holes 72 are holes holding the second male terminals 12 for communication.

The male unit 3 will be described hereinafter using the first direction X, the second direction Y, and the third direction Z described above. The first direction X is a direction in which the first male terminals 11 and the second male terminals 12 are inserted into the male housing 7. The male housing 7 according to the present embodiment has a substantially rectangular cross section orthogonal to the first direction X. The second direction Y is a longitudinal direction in the cross section of the male housing 7, and the third direction Z is a short direction in the cross section. In other words, the first direction X, the second direction Y, and the third direction Z in the male housing 7 are directions in a state in which the male housing 7 is fitted into the female housing 4.

The shield case 8 is a member attached to the male housing 7 from outside and covering the second holding portion 45 of the female housing 4. The shield member 9 is a tubular member covering the communication connector 61 and the second male terminals 12. The peg 10 is a member attached to the male housing 7 and fixed on the substrate 100. The male housing 7 includes a gap portion 7*e* into which the peg 10 is press-fitted. The peg 10 is fixed to the substrate 100 with, for example, solder.

As illustrated in FIG. 10 and FIG. 11, the male housing 7 includes a first portion 7*m* and a second portion 7*n*. The first portion 7*m* is a portion corresponding to the first holding portion 44 of the female housing 4. The second portion 7*n* is a portion corresponding to the second holding portion 45 of the female housing 4. The first portion 7*m* is located on one side in the second direction Y in the male housing 7, and the second portion 7*n* is located on the other side in the second direction Y in the male housing 7.

The first holding holes 71 are arranged in the first portion 7*m*. In the first portion 7*m*, the first holding holes 71 arranged along the second direction Y are arranged in two lines superimposed in the third direction Z. The second holding holes 72 are arranged in the second portion 7*n*. The second portion 7*n* includes a block portion 73 and a slit portion 7*f*. The block portion 73 has a substantially rectangular parallelepiped shape. The slit portion 7*f* is provided to surround the block portion 73 from three sides. The slit portion 7*f* extends through the male housing 7 along the first direction X. An insertion portion 92*a* (see FIG. 14) of the shield member 9 is inserted into the slit portion 7*f* and surrounds the block portion 73 from three sides.

The second holding holes 72 are formed in the block portion 73. The second holding holes 72 extend through the block portion 73 along the first direction X. The two second holding holes 72 are arranged side by side in the second direction Y. A groove 7*g* extending in the third direction Z is formed in a back surface 7*a* of the male housing 7. The groove 7*g* is located in a border portion between the first portion 7*m* and the second portion 7*n*.

As illustrated in FIG. 11, the male housing 7 includes a recessed portion 74 configured to fit with the female housing 4. The recessed portion 74 is opened in a front surface 7*b* of the male housing 7. The recessed portion 74 is recessed from the front surface 7*b* toward the back surface 7*a* along the first direction X. The first holding holes 71 and the second holding holes 72 are opened toward the recessed portion 74. A cross-sectional shape of the recessed portion 74 in a cross section orthogonal to the first direction X corresponds to the cross-sectional shape of the female housing 4. The cross-sectional shape of the recessed portion 74 is, for example, a substantially rectangular shape. The recessed portion 74 is provided with an engagement portion engaged with the female housing 4 and lock the female housing 4.

The male housing 7 includes a first side surface 7*c* and a second side surface 7*d*. The first side surface 7*c* is a surface opposed to the substrate 100 in a state in which the male housing 7 is fixed on the substrate 100. The second side surface 7*d* is a surface oriented to a side opposite to the first side surface 7*c*. As illustrated in FIG. 9 and FIG. 11, a groove 75 is formed in the second side surface 7*d*. The groove 75 extends along the first direction X. Specifically, the extending direction of the groove 75 is a direction in which the female housing 4 is inserted into the male housing 7. The groove 75 extends in a straight line from the vicinity of the back surface 7*a* to the vicinity of the front surface 7*b*. The groove 75 is located on a border between the first portion 7*m* and the second portion 7*n*.

As illustrated in FIG. 12, each of the first male terminals 11 includes a first connection portion 11*a*, a second connection portion 11*b*, and a middle portion 11*c*. The first connection portion 11*a*, the second connection portion 11*b*, and a middle portion 11*c* are formed of, for example, a conductive metal plate. The first connection portion 11*a* is a portion to be inserted into the first female terminal 51 and electrically connected with the first female terminal 51. The first connection portion 11*a* is press-fitted into the first holding hole 71 of the male housing 7, and held with the first holding hole 71. The second connection portion 11*b* is a portion fixed on the first electrode part 101 of the substrate 100. The middle portion 11*c* is a portion connecting the first connection portion 11*a* and the second connection portion 11*b*. Each of the first male terminals 11 is bent such that the first connection portion 11*a* and the second connection portion 11*b* are orthogonal to the middle portion 11*c*.

As illustrated in FIG. 13, each of the second male terminals 12 includes a first connection portion 12*a*, a second connection portion 12*b*, and a middle portion 12*c*. The first connection portion 12*a*, the second connection portion 12*b*, and the middle portion 12*c* are formed of, for example, a conductive metal plate. The first connection portion 12*a* is a portion inserted into the second female terminal 63 and electrically connected with the second female terminal 63. The first connection portion 12*a* is press-fitted into the second holding hole 72 of the male housing 7, and held with the second holding hole 72. The second connection portion 12*b* is a portion fixed on the second electrode part 102 of the substrate 100. The middle portion 12*c* is a portion connecting the first connection portion 12*a* and the second connection portion 12*b*. Each of the second male terminals 12 is bent such that the first connection portion 12*a* and the second connection portion 12*b* are orthogonal to the middle portion 12*c*.

As illustrated in FIG. 14, the shield member 9 has a substantially square tube shape. The shield member 9 is formed of, for example, a conductive metal plate, such as brass. The shield member 9 includes a tubular portion 91 and a cover portion 92. The tubular portion 91 is a portion having a square tube shape and located on one side in the first direction X. The tubular portion 91 is fitted with the shield member 67 of the communication connector 61 and electrically connected with the shield member 67. The tubular portion 91 includes spring portions 91*a* contacting the shield member 67.

The cover portion 92 includes an insertion portion 92*a* and a lid portion 92*b*. The insertion portion 92*a* includes a top wall 92*c* and a pair of side walls 92*d*. The insertion portion 92*a* is inserted into the slit portion 7*f* of the male housing 7. The lid portion 92*b* is connected with the top wall 92*c* via hinge portions 92*e*. The hinge portions 92*e* are portions having flexibility. Before the shield member 9 is inserted into the male housing 7, the hinge portions 92*e* are in a straight-line state. In this case, as illustrated with two-dot chain lines in FIG. 14, the hinge portions 92*e* and the lid portion 92*b* connect to the top wall 92*c* to form a plate-like shape. When the insertion portion 92*a* is inserted into the slit portion 7*f* of the male housing 7, the lid portion 92*b* projects from the slit portion 7*f*. Thereafter, the hinge portions 92*e* are bent at substantially right angles. In this manner, the lid portion 92*b* covers the second male terminal 12 to protect the second male terminal 12 from noise.

As illustrated in FIG. 15, the shield case 8 includes a top wall 81, a first side wall 82, a second side wall 83, an insertion wall portion 84, and a partition wall 85. Each of the top wall 81, the first side wall 82, the second side wall 83, the insertion wall portion 84, and the partition wall 85 are formed of, for example, a conductive metal plate, such as brass. The top wall 81 is a portion covering the second side surface 7*d* of the male housing 7. The top wall 81 covers a region belonging to the second portion 7*n* in the second side surface 7*d*. The top wall 81 has, for example, a rectangular shape.

The first side wall 82, the second side wall 83, the insertion wall portion 84, and the partition wall 85 are connected with edge portions of the top wall 81 and substantially orthogonal to the top wall 81. The first side wall 82 is a wall portion covering the second portion 7*n* of the male housing 7 from the side. A distal end of the first side wall 82 is provided with a fixing portion 82*a* fixed on the substrate 100 with solder or the like.

The second side wall 83 is a wall portion covering the back surface 7*a* of the male housing 7. More specifically, the second side wall 83 covers a region belonging to the second portion 7*n* in the back surface 7*a*. A distal end of the second side wall 83 is provided with a pair of ground portions 83*a*. The ground portions 83*a* are fixed on the ground conductors of the substrate 100 and electrically connected with the ground conductors. The shield case 8 is grounded with the ground portions 83*a*. The second side wall 83 includes a pair of spring portions 83*b*. The spring portions 83*b* are bent toward the inside of the shield case 8. The spring portions 83*b* contact the lid portion 92*b* of the shield member 9 and are electrically connected with the lid portion 92*b*. Specifically, in the connector structure 1 according to the present embodiment, the shield member 9 and the shield member 67 of the communication connector 61 are grounded via the shield case 8.

The insertion wall portion 84 is opposed to the first side wall 82 in the second direction Y. The insertion wall portion 84 is a wall portion inserted into the groove 75 of the male housing 7. The insertion wall portion 84 may be press-fitted into the groove 75. By holding the insertion wall portion 84 with the groove 75, oscillation of the insertion wall portion 84 and the shield case 8 is appropriately suppressed. The insertion wall portion 84 has, for example, a rectangular shape.

The partition wall 85 is adjacent to the insertion wall portion 84 in the first direction X. The partition wall 85 is a wall portion separating the first male terminals 11 from the second male terminals 12. The partition wall 85 is formed such that, for example, the distal end of the partition wall 85 contacts the surface of the substrate 100. The partition wall 85 is inserted into the groove 7*g* provided in the back surface 7*a* of the male housing 7. The partition wall 85 is inserted into the groove 7*g* to separate the space on the first male terminals 11 side from the space on the second male terminals 12 side.

FIG. 16 illustrates a cross section taken along line XVI-XVI of FIG. 2. FIG. 17 illustrates a cross section taken along line XVII-XVII of FIG. 2. As illustrated in FIG. 16 and FIG. 17, the shield layer 49 of the holding member 41 separates the first holding portion 44 from the second holding portion 45. As illustrated in FIG. 16, the shield layer 49 is opposed to substantially the whole range of the first female terminals 51 extending from the front end to the rear end of the first female terminals 51. The shield layer 49 is also opposed to part of the electrical wires 52.

As illustrated in FIG. 17, the shield layer 49 extends in the main member 40 from the vicinity of the first side surface 40*b* to the vicinity of the second side surface 40*d* along the third direction Z. The shield layer 49 is opposed to each of the first female terminals 51 arranged in two lines, and separates the first female terminals 51 from the second female terminals 63. As described above, the connector structure 1 according to the present embodiment includes the conductive shield layer 49 separating the first holding portion 44 from the second holding portion 45. Accordingly, the connector structure 1 according to the present embodiment enables suppression of reduction in quality of communications performed via the second female terminals 63 and the communication cable 62.

FIG. 18 illustrates a cross section taken along line XVIII-XVIII of FIG. 1. As illustrated in FIG. 18, the shield case 8 includes the insertion wall portion 84 inserted into the groove 75 of the male housing 7. The insertion wall portion 84 protects the second female terminals 63 and/or the second male terminals 12 from noise in cooperation with the shield layer 49 and the shield member 9. The insertion wall portion 84 is positioned in a border portion between the first holding portion 44 and the second holding portion 45, and protects the second holding portion 45 from noise generated in the first holding portion 44. The insertion wall portion 84 according to the present embodiment is opposed to the partition wall 48 in the depth direction of the groove 75. As illustrated in FIG. 18, the distal end of the insertion wall portion 84 and the distal end of the partition wall 48 are opposed to each other in the third direction Z. This structure minimizes the space between the shield layer 49 and the insertion wall portion 84. Minimizing the space between the shield layer 49 and the insertion wall portion 84 maximizes the effect of noise reduction achieved with the shield layer 49 and insertion wall portion 84.

As described above, the connector structure 1 according to the present embodiment includes the female housing 4 and the male housing 7. The female housing 4 includes the first holding portion 44, the second holding portion 45, and the shield layer 49. The first holding portion 44 is a portion holding the first female terminals 51 for power supply. The second holding portion 45 is adjacent to the first holding portion 44 and formed as one unitary piece with the first holding portion 44. The second holding portion 45 is a portion holding the second female terminals 63 for communication. The shield layer 49 has conductivity and separates the first holding portion 44 from the second holding portion 45. The male housing 7 is a housing including the recessed portion 74 configured to fit with the female housing 4, and holding the first male terminals 11 and the second male terminals 12. The first male terminals 11 are terminals to be connected with the first female terminals 51, and the second male terminals 12 are terminals to be connected with the second female terminals 63.

The connector structure 1 according to the present embodiment is capable of protecting, with the shield layer 49, the second female terminals 63 and the second male terminals 12 from an influence of noise. The shield layer 49 protects the communication lines from, for example, noise generated in the first holding portion 44. Accordingly, the connector structure 1 according to the present embodiment enables suppression of reduction in communication quality. The connector structure 1 according to the present embodiment enables compatibility with the communication standard of higher speed by reduction of an influence of noise.

The female housing 4 according to the present embodiment includes the main member 40 into which the first female terminals 51 and the second female terminals 63 are inserted, and the holding member 41. The holding member 41 is a member engaged with the main member 40 to hold the first female terminals 51. The holding member 41 includes the partition wall 48 separating the first holding portion 44 from the second holding portion 45. The shield layer 49 is provided on the partition wall 48. When the shield layer 49 is provided on the partition wall 48, the shield layer 49 can be easily set in comparison with the case of providing the shield layer 49 inside the main member 40.

The shield layer 49 according to the present embodiment is a plated layer formed on the partition wall 48. This structure enables reduction in thickness of the shield layer 49.

The connector structure 1 according to the present embodiment further includes the conductive shield case 8 and the conductive tubular shield member 9. The shield case 8 is a member attached to the male housing 7 to cover the second holding portion 45 and grounded to the substrate 100. The shield member 9 is a member disposed in the recessed portion 74, grounded via the shield case 8, and covering the connection portion between the second male terminals 12 and the second female terminals 63.

The outer side surface of the male housing 7 includes the groove 75 formed along the border between the first holding portion 44 and the second holding portion 45. The shield case 8 includes the insertion wall portion 84 inserted into the groove 75. This structure enables protection of the communication lines from noise with the insertion wall portion 84.

The insertion wall portion 84 according to the present embodiment is opposed to the partition wall 48 in the depth direction of the groove 75. This structure enables protection of the communication lines from noise with the shield layer 49 and the insertion wall portion 84 in cooperation with each other.

First Modification of Embodiment

Figure 19:
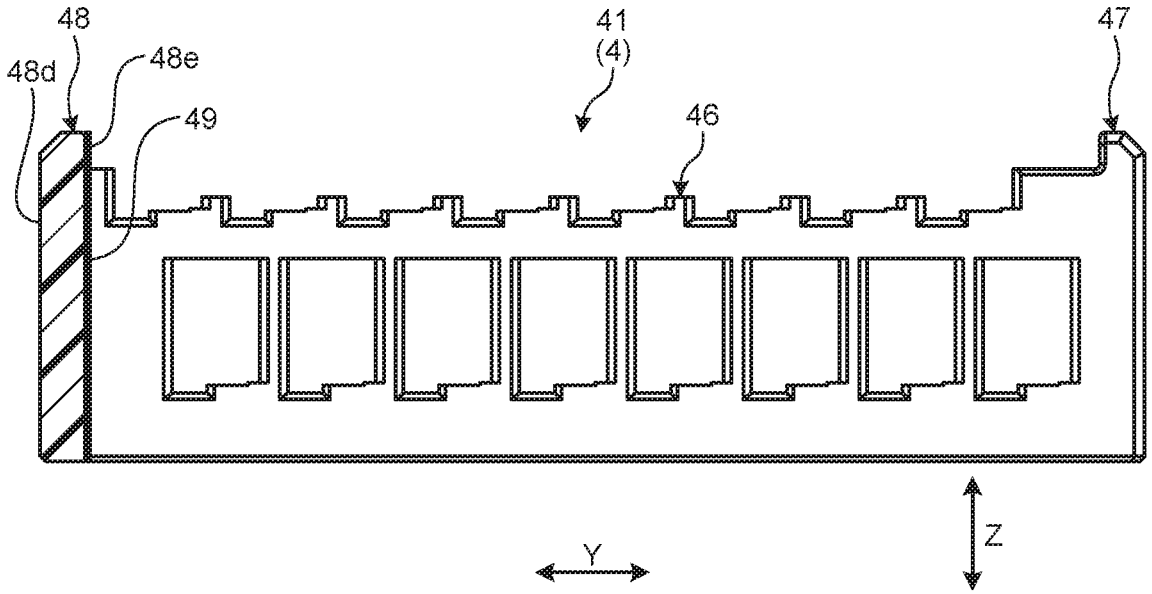
FIG. 19 is a cross-sectional view of a holding member according to a first modification of the embodiment.
Figure 20:
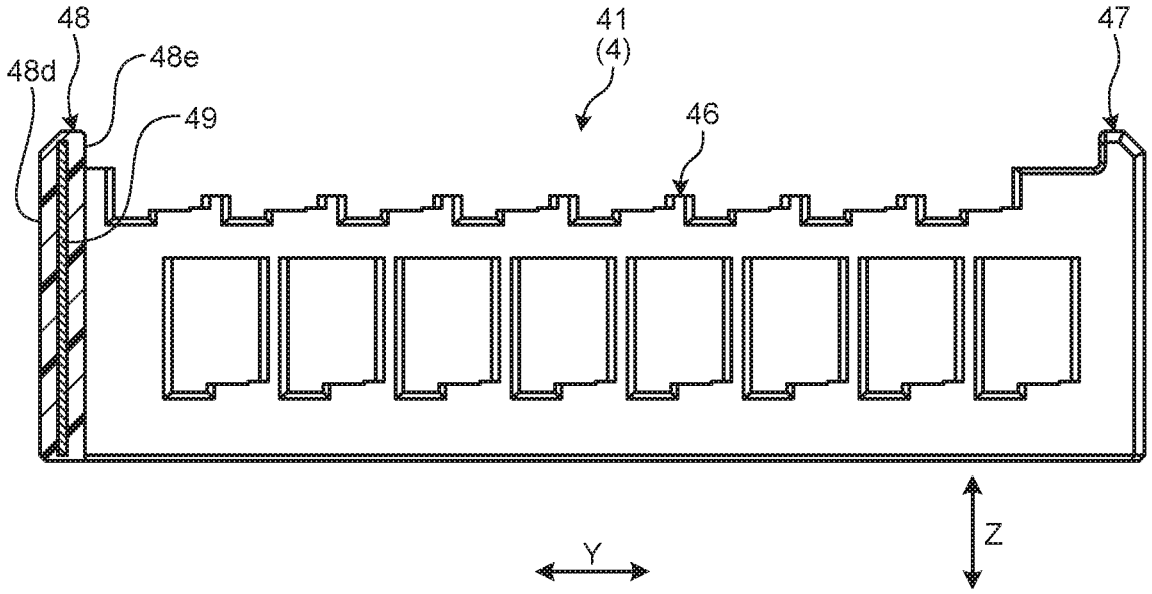
FIG. 20 is a cross-sectional view of another holding member according to the first modification of the embodiment.

The following is an explanation of a first modification of the embodiment. FIG. 19 is a cross-sectional view of the holding member according to the first modification of the embodiment, and FIG. 20 is a cross-sectional view of another holding member according to the first modification of the embodiment. The shield layer 49 may be provided on an inner side surface 48*e* of the partition wall 48, as illustrated in FIG. 19.

The shield layer 49 is not limited to a plated layer, but may be, for example, a conductive metal plate or a conductive metal film. For example, the shield layer 49 may be a metal plate or a metal film fixed on at least one of the outer side surface 48*d* and the inner side surface 48*e* of the partition wall 48. The shield layer 49 may be disposed inside the partition wall 48, as illustrated in FIG. 20. The shield layer 49 may be a metal plate disposed inside the partition wall 48 by insert molding, for example.

The shield layer 49 may be provided on the main member 40 of the female housing 4. In this case, the main member 40 is preferably provided with a partition wall separating the first holding portion 44 from the second holding portion 45. The shield layer 49 may be a plated layer formed on the partition wall of the main member 40, or a metal plate or a metal film fixed on the partition wall of the main member 40.

The position and/or the shape of the insertion wall portion 84 of the shield case 8 are not limited to the position and/or the shape illustrated in the embodiment described above. For example, the insertion wall portion 84 may be disposed located on substantially the same plane as that of the shield layer 49. The insertion wall portion 84 may be disposed so as to be located on substantially the same plane as one side surface of the shield member 9.

Second Modification of Embodiment

The following is an explanation of a second modification of the embodiment. The number of the first female terminals 51 and/or the number of the second female terminals 63 inserted into the female housing 4 are not limited to the numbers illustrated in the embodiment. In the connector structure 1, the male unit 3 is not limited to a substrate connector fixed on the substrate 100. For example, the connector structure 1 may be a structure connecting an electrical wire with an electrical wire. For example, the first male terminals 11 may be terminals connected to electrical wires for power supply. The second male terminals 12 may be terminals connected to a communication cable or the like.

The details disclosed in the embodiment and the modifications described above may be carried out in proper combinations.

The female housing of the connector structure according to the embodiment includes the first holding portion holding the first female terminals for power supply, the second holding portion formed as one unitary piece with the first holding portion and holding the second female terminals for communication, and the conductive shield layer separating the first holding portion from the second holding portion. The connector structure according to the embodiment produces the effect of suppressing reduction in communication quality with the conductive shield layer separating the first holding portion from the second holding portion.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector structure comprising:

a female housing including a first holding portion configured to hold first female terminals for power supply, a second holding portion adjacent to the first holding portion, formed as one unitary piece with the first holding portion, and configured to hold second female terminals for communication, and a conductive shield layer configured to separate the first holding portion from the second holding portion; and a male housing including a recessed portion configured to fit with the female housing, and configured to hold first male terminals to be connected with the first female terminals and second male terminals to be connected with the second female terminals, wherein the female housing includes a main member into which the first female terminals and the second female terminals are inserted, and a holding member configured to be engaged with the main member to hold the first female terminals, the holding member includes a partition wall configured to separate the first holding portion from the second holding portion, and the shield layer is provided on the partition wall.

2. The connector structure according to claim 1, wherein the shield layer is a plated layer formed on the partition wall.

3. The connector structure according to claim 1, further comprising:

a conductive shield case configured to be attached to the male housing to cover the second holding portion and grounded to a substrate; and a conductive tubular shield member disposed in the recessed portion, grounded via the shield case, and covering a connection portion between the second male terminals and the second female terminals, wherein an outer side surface of the male housing includes a groove formed along a border between the first holding portion and the second holding portion, and the shield case includes an insertion wall portion configured to be inserted into the groove.

4. The connector structure according to claim 2, further comprising:

a conductive shield case configured to be attached to the male housing to cover the second holding portion and grounded to a substrate; and a conductive tubular shield member disposed in the recessed portion, grounded via the shield case, and covering a connection portion between the second male terminals and the second female terminals, wherein an outer side surface of the male housing includes a groove formed along a border between the first holding portion and the second holding portion, and the shield case includes an insertion wall portion configured to be inserted into the groove.

5. The connector structure according to claim 3, wherein the insertion wall portion is opposed to the partition wall in a depth direction of the groove.

6. The connector structure according to claim 4, wherein the insertion wall portion is opposed to the partition wall in a depth direction of the groove.

7. A housing comprising:

a first holding portion configured to hold first female terminals for power supply;

a second holding portion adjacent to the first holding portion, formed as one unitary piece with the first holding portion, and configured to hold second female terminals for communication; and a conductive shield layer configured to separate the first holding portion from the second holding portion, wherein the female housing includes a main member into which the first female terminals and the second female terminals are inserted, and a holding member configured to be engaged with the main member to hold the first female terminals, the holding member includes a partition wall configured to separate the first holding portion from the second holding portion, and the shield layer is provided on the partition wall.

* * * * *